United States Patent [19]

Schreckenstein

[11] Patent Number: 4,757,894

[45] Date of Patent: Jul. 19, 1988

[54] CARRYING CASE FOR SHOTGUN SHELLS

[76] Inventor: William Schreckenstein, Box 61A Mosquito Point Rd., Munnsville, N.Y. 13409

[21] Appl. No.: 892,377

[22] Filed: Aug. 4, 1986

[51] Int. Cl.[4] ..... F42B 39/02

[52] U.S. Cl. ..... 206/3; 206/589; 206/1.5; 224/239; 224/241; 224/253

[58] Field of Search ..... 206/3, 589, 590, 591, 206/419, 1.5; 224/253, 239, 203, 252, 240, 241, 914; 42/72.01; 220/306, 323, 324

[56] References Cited

U.S. PATENT DOCUMENTS

| | | | |
|---|---|---|---|
| 394,376 | 12/1888 | Kelton | 42/72.01 |
| 2,928,530 | 3/1960 | Sauey | 206/3 |
| 2,995,280 | 8/1961 | Thierry . | |
| 3,317,097 | 5/1967 | Giordano . | |
| 3,769,733 | 11/1973 | Nelson . | |
| 3,923,152 | 12/1975 | Minneman | 206/3 |
| 4,004,734 | 1/1977 | Hadtke | 220/306 X |
| 4,262,833 | 4/1981 | DeSantis . | |
| 4,381,845 | 5/1983 | Feis . | |
| 4,387,805 | 6/1983 | Lanius . | |
| 4,467,947 | 8/1984 | Minneman . | |
| 4,613,042 | 9/1986 | Aeschliman | 206/419 |

*Primary Examiner*—Henry J. Recla
*Assistant Examiner*—David Voorhees
*Attorney, Agent, or Firm*—Wall and Roehrig

[57] ABSTRACT

A shotgun shell case including a box-like receptacle having a horizontal bottom wall, vertical side walls and a plurality of individual cylindrical shell receiving pockets depending from the bottom wall which have shelf engaging projections for holding shells inserted therein firmly in place. The case further includes a hinged cover and means to attach the case to the belt of a user.

14 Claims, 2 Drawing Sheets

CARRYING CASE FOR SHOTGUN SHELLS

BACKGROUND OF THE INVENTION

This invention relates to a fully enclosed carrying case for shotgun shells in which the shells are stored securely in individual easily accessable pockets.

Shotgun shells are relatively bulky items when compared to rifle or pistol cartridges and thus present special carrying and handling problems for hunters and sportsmen in the field where quick access to the shells is needed. Many bandolier type pouches, such as those described in U.S. Pat. Nos. 2,995,280 and 4,262,833, have been devised wherein each shell is suspended in a vertical position upon hangers. For the most part these pouches are relatively flimsy devices from which the shells can be easily dislodged. A good portion of the shell is also exposed so that it can become wet during inclement weather, as typically experienced in the field. By the same token the exposed portion of the shells oftentimes snags on foreign objects, such as bushes and the like, thus causing the shell to become dislodged from the pouch.

A more fully enclosed carrying case for rifle cartridges is described in U.S. Pat. No. 4,467,947 that involves two hinged half sections that are designed to close over the cartridges. The cartridges are stored in individual open ended tubes mounted upon fold-out boards to provide ease of access to the cartridges when the half sections are opened. The open ended tubes have no means by which the cartridges can be indexed within the case. As a consequence, the cartridges can be either over inserted or under inserted within the tubes. In either event the cartridges can become misaligned within the case. This can prevent the case from closing and cause the fold-out boards to be bent or otherwise damaged. Furthermore, this type of fold-out mechanism is generally unsuited for use in conjunction with shotgun shells because the case must be overly large and thus too unwieldly for use in the field.

Another drawback associated with most carrying cases, and particularly those used to carry shotgun shells in the field, is the unreliability of the clasps used to secure the case in a closed position. Where the case is of a molded plastic construction, the clasps are generally poorly designed and the cover can be easily jarred open under normal field conditions. When this occurs the shells usually spill out of the case and become lost in the brush.

SUMMARY OF THE INVENTION

It is therefore an object of the present invention to improve cases for carrying shotgun shells.

It is a further object of this invention to provide a carrying case having a moldable latch that provides a positive lock that can be quickly and easily opened under all kinds of conditions.

Yet a further object of the present invention is to provide a carrying case for shotgun shells that can be belt mounted and in which the shells are completely shielded from the elements.

Another object of the present invention is to provide a carrying case for shotgun shells that is easily moldable in one operation and wherein the shells are all easily indexed in a uniform stored position so that the cover of the case can be easily opened and closed without becoming fowled.

Still another object of the present invention is to securely store individual shotgun shells in a weather-tight carrying case in an upright position whereby there is sufficient finger space between shells so that they can be easily removed from the case.

These and other objects of the present invention are attained by a molded one piece carrying case for storing shotgun shells that includes a box-like receptacle having a bottom wall and perpendicular sidewalls a top cover connected to one side wall by a hinge, a latch for securing the cover to the receptacle, a plurality of individual shell receiving cylinders depending from the bottom wall of the receptacle, each cylinder having a bottom closure lying in a common plane against which the shells are indexed and shell engaging projections formed on the interior wall for securely retaining a shell in the pocket.

BRIEF DESCRIPTION OF THE DRAWINGS

For a better understanding of these and other objects of the present invention reference is had to the following detailed description of the invention which is to be read in conjunction with the associated drawings, wherein.

DESCRIPTION OF THE INVENTION

Figure 1:
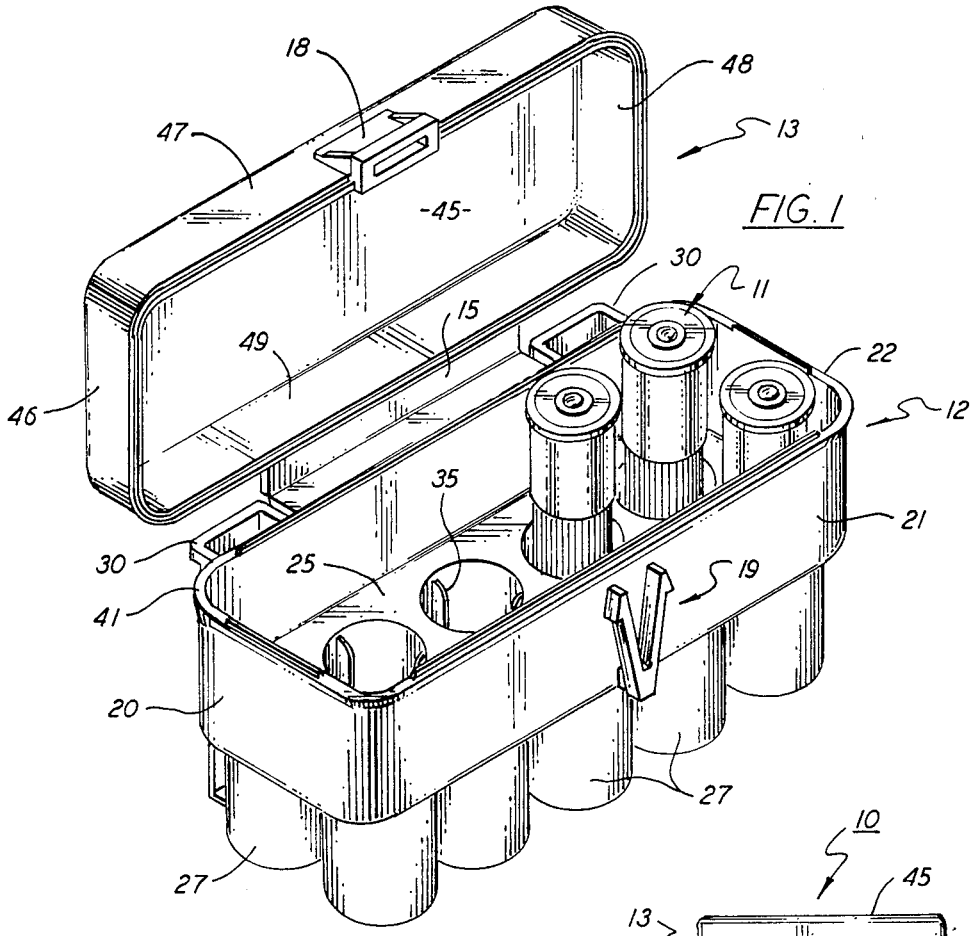
FIG. 1 is a perspective view of a carrying case having individual retaining pockets for shotgun shells that embodies the teachings of the present invention.
Figure 3:
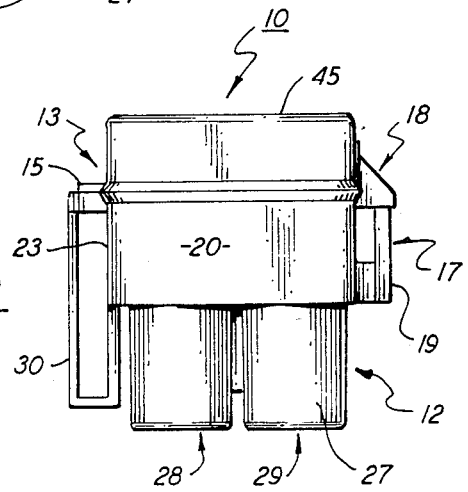
FIG. 3 is an end view of carrying case illustrated in FIG. 2.
Figure 2:
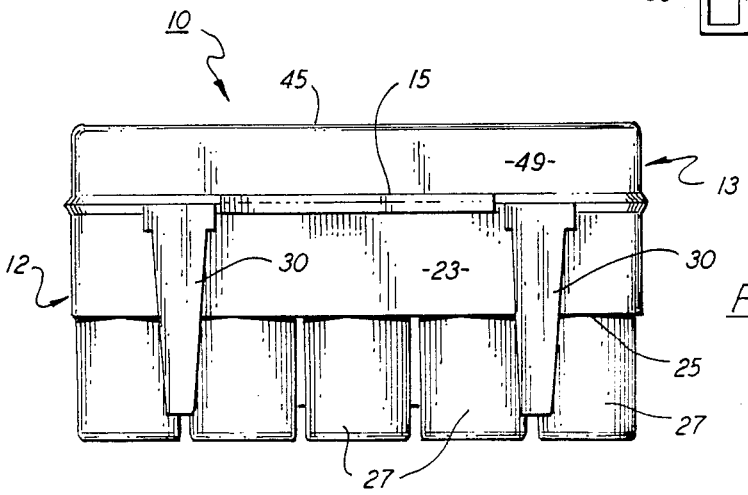
FIG. 2 is a rear elevation showing the carrying case of FIG. 1 with the cover closed.
Figure 4:
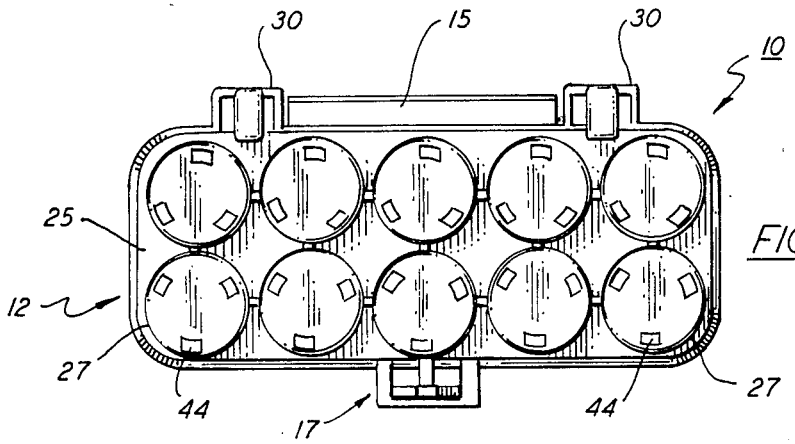
FIG. 4 is a bottom view of the carrying case shown in FIG. 2.

Referring now to the drawings and in particular to FIGS. 1–5, there is shown a carrying case, generally referenced 10, that is designed to carry a plurality of shotgun shells 11-11 in two rows within a receptacle 12. A cover or top closure 13 is connected to the receptacle by means of a hinge 15 whereby the cover can be opened and closed against the receptacle to provide a weather-tight enclosure. As will be explained in greater detail below the case is provided with a clasp mechanism generally depicted at 17 in FIG. 3 which functions to hold the cover tightly closed against the receptacle at closure. The clasp mechanism includes a female member 18 secured to the cover and a coacting V-shaped male member 19 secured to the receptacle.

The receptacle includes four vertical side walls 20–23 that are integral with a horizontal bottom wall 25. A plurality of cylindrical shaped pockets 27-27 depend downwardly from the bottom wall with the cylinders being spaced apart in two parallel rows 28 and 29. A pair of spaced belt loops 30-30, that are integral with the back wall 23 of the receptacle 12, are provided at the rear of the case which permits the case to be attached to a belt for carrying shells in the field in an upright position. The case can also be removed from the belt and stored in any convenient place such as a knapsack or the like. As will be apparent from the present disclosure the case provides a convenient high strength weather-tight container that is capable of securely and safely retaining a number of shells therein.

Figure 5:
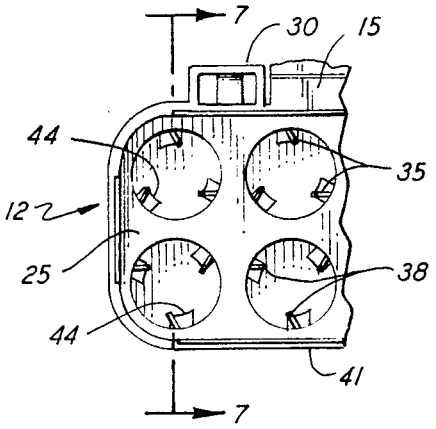
FIG. 5 is a partial top view of the carrying case shown in FIG. 1 with the cover open showing inwardly spaced vanes projecting from the interior wall of the individual shell retaining pockets.
Figure 7:
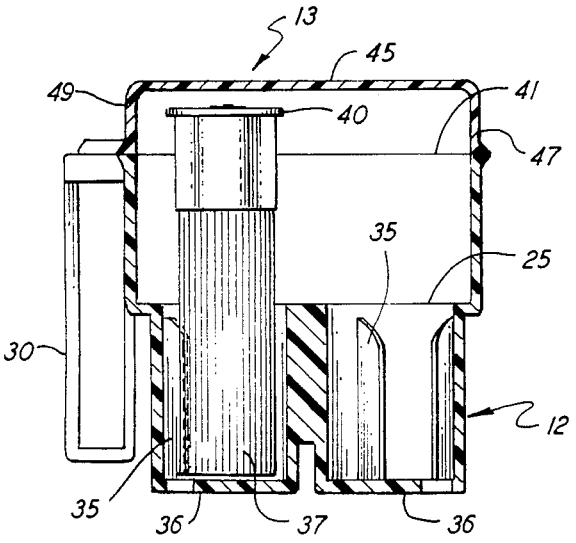
FIG. 7 is an enlarged sectional view taken along lines 7—7 in FIG. 5 further showing a shell seated in one of the pockets.

With further reference to FIG. 5, each pocket 27 contains three inwardly projected vanes 35-35 that extend axially substantially along the entire interior wall length of the pocket. Each cylinder also includes a lower closure wall 36 with all closure walls lying in a common plane that is parallel with the bottom wall of the receptacle. As illustrated in FIG. 7 a shot gun shell 11 stored in the case is inserted into a pocket with the front or slug end 37 of the shell facing down. The diameter of the pocket opening, as described by inner surfaces 38-38 (FIG. 5), of the vanes is slightly less than the outside diameter of the shell casing so that a slight interference fit is provided therebetween.

The shell 11 is retained by the vanes by pushing the shell downwardly into a pocket until the slug end thereof is indexed against the pocket closure wall. This automatically positions the slug in a vertical condition with the rim 40 of the casing elevated above the top surface 41 of the receptacle. The center distance between the adjacent pockets is greater than the diameter of the shells at the rim. Sufficient distance is provided between pockets so that each retained shell in the case is easily finger engageable, even when the case is fully loaded, to permit quick and sure removal of individual shells from the case when it is worn on the belt of the user. Holes 44-44 are also provided in the closure wall of each pocket to permit moisture and other foreign matter that might collect therein to be easily removed from the pocket.

The hinged cover 13 of the case contains a top wall 45 and four dependent side walls 46–49 which, at closure, are aligned in abutting contact against the sidewalls 20–23 of the receptacle 12. The side walls of the cover provide a deep recess within the cover in which the top or rim portion of the stored shells are housed when the cover is closed and latched against the receptacle. Opening the cover as shown in FIG. 1 provides ready access to the rims of the shells that protrude above the top surface of the receptacle.

Figure 6:
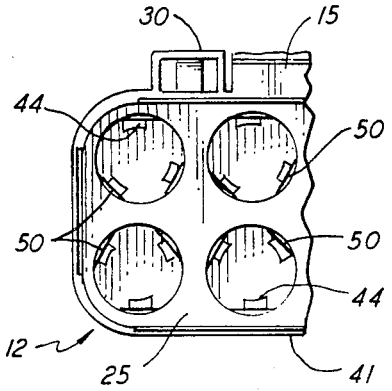
FIG. 6 is a view similar to that of FIG. 5 showing another embodiment of the invention wherein the shell engaging projections are spaced flats.

FIG. 6 illustrates another embodiment of the invention wherein the pocket vanes 35-35 (FIG. 5) are replaced with inwardly projecting flats or bosses 50-50 that are spaced about the inner periphery of each pocket. In this case three equally spaced flats are used in each pocket with the flats extending axially along the length of the pocket. The inner surfaces 51-51 of the flats describe a circle that has a diameter slightly less than the outside diameter of the shell casings intended to be stored therein. A tight press fit is thus provided between the flats and shell which serves to again securely hold the shell within the pocket. As in the case of the vanes, the flats prevent the shell from becoming dislodged even when the case is subjected to severe oscillations, as for example when the wearer is running, or when the case is heavily impacted by a foreign object.

Figure 8:
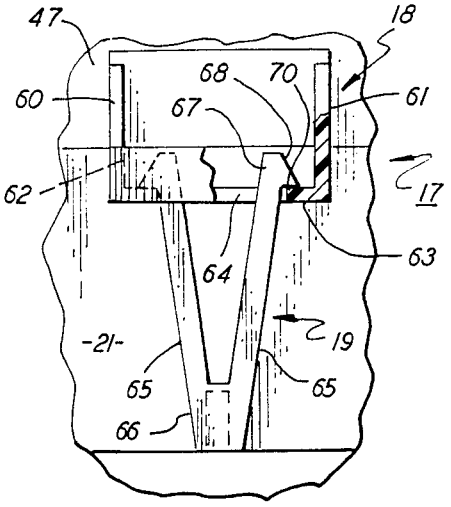
FIG. 8 is an enlarged partial front view showing a molded clasp for securing the cover of the present carrying case to the shell retaining receptacle.

With further reference to FIG. 8, the two piece clasp 17 used to secure the cover to the receptacle is shown in greater detail. The female member 18 consists of an open bottomed frame having two inclined side walls 60 and 61, that are secured to the front wall 47 of the cover, a front cross member 62, and a lower wall 63 having an opening 64 formed therein. The male member 19 includes a V-shaped element having two legs 65-65 cantilevered from a base 66 secured to the front wall 21 of the receptacle. The legs are formed of a resilient material, such as plastic, that permits the legs to be pinched inwardly towards one another. The distal or top ends of the legs are equipped with dependent hooks 67-67. Each hook has an inclined camming surface 68 that terminates at the lower end thereof with a recessed shoulder 70. The camming surfaces are arranged to engage opposed edges of the opening 64 formed in the bottom wall 63 of the female member to cam the legs inwardly as the cover is moved to a closed position. When the cover is completely closed against the receptacle, the recessed shoulders of the hooks have passed over the top of the lower wall 63 and automatically snap outwardly over the lower wall to secure the cover in a closed and locked condition.

To open the cover, the two legs are pinched together and the cover raised in the position shown in FIG. 1. Preferably the hinge is biased toward an open position so that the cover will then automatically spring open when the clasp is released.

The entire structure of the present carrying case is designed so that the case can be molded as an integral or united unit using a suitable plastic. The plastic preferably has sufficient strength and resiliency to permit the clasp mechanism and hinge to function as herein described. The pastic material should exhibit high impact resistance so that the case will not be damaged if dropped or struck a heavy blow. As should now be evident from the disclosure above, the present case is extremely strong, relatively impervious to weather, capable of securely retaining shells in a stored condition, provides easy access to shells and can be cast in one step within a mold.

While this invention has been described with reference to the structure disclosed herein, it is not confined to the details set forth and this application is intended to cover any modifications or changes that may come within the scope of the following claims.

I claim:

1. A shotgun shell carrying case comprising an open box-like receptacle that includes a bottom wall and at least one side wall, said bottom wall containing a plurality of cylindrical orifices therein, a plurality of individual cylindrical shell receiving pockets depending from said receptacle and formed integrally therewith, each of said pockets communicating with said receptacle through said orifices respectively, each of said pockets being spaced apart from each other such that a retained shell in each of said pockets is easily finger engageable, each of said pockets also having interior shell engaging projections for holding the shell firmly in the pocket and a closure wall against which the front face of a shell is seated, the depth of each of said depending shell receiving pockets being such that only the lower portion of the shell is positioned therein while the upper portion of the shell projects upwardly into the open box-like receptacle for easy finger engagement with the shell.

2. A carrying case as defined in claim 1 together with an operable top closure for the receptacle, said closure being hingedly connected to one of the receptacle side walls.

3. A carrying case as defined in claim 2 including contacting clasp elements on the receptacle and top closure for releasably holding the latter in a closed position against the receptacle.

4. A carrying case as defined in claim 1 wherein said shell engaging projections are inwardly projecting spaced vanes.

5. A carrying case as defined in claim 1 wherein said shell engaging projections are spaced flats on the pocket interior wall.

6. A carrying case as defined in claim 1 wherein each of said closure walls contains a plurality of holes therein for permitting moisture and other foreign matter to be removed from its associated pocket.

7. A plastic shotgun shell carrying case of unitary construction, the case comprising an open lower box-like section that includes a bottom wall and side walls, said bottom wall containing a plurality of cylindrical orifices therein, a top closure section connected to one of the side walls of the lower section by hinge means formed integrally therewith, a plurality of cylindrical shell receiving pockets depending from said lower section and formed integrally therewith, each of said pockets communicating with said lower section through said orifices respectively, each of said pockets being spaced apart from each other such that a retained shell in each of said pockets is easily finger engageable, each of said pockets having a bottom closure on which the shell rests, clasp means for releasably holding the top closure section in a closed position against the lower section, the clasp means consisting of a female element integral with one of said sections and a male element integral with the other section, the depth of each of said depending shell receiving pockets being such that only the lower portion of the shell is positioned therein while the upper portion of the shell projects upwardly into the lower section for easy finger engagement with the shell.

8. A carrying case as defined in claim 7 wherein each of said shell receiving pockets is formed with interior shell engaging projections for holding the shell firmly in the pocket.

9. A carrying case as defined in claim 8 wherein said shell engaging projections are inwardly extending spaced vanes.

10. A carrying case as defined in claim 8 wherein said shell engaging projections are spaced flats on the pocket interior wall.

11. A carrying case defined in claim 7 wherein each of said bottom closures contains a plurality of holes therein for permitting moisture and other foreign matter to be removed from its associated pocket.

12. A carrying case comprising a box-like receptacle that includes a bottom wall and side walls, said bottom wall containing a plurality of orifices therein, an operable top closure for the receptacle hingedly connected to one of its side walls, a plurality of individual cylindrical shell receiving pockets depending from said receptacle and formed integrally therewith, each of said pockets communicating with said receptacle through said orifices respectively, each of said pockets being spaced apart from each other such that a retained shell in each of said pockets is easily finger engageable, each of said pockets having a bottom closure on which the shell rests, and clasp means for releasably holding the top closure in closed position, the clasp consisting of a keeper element formed integrally with the top closure and a resilient V-shaped element formed integrally with a receptacle side wall and engageable with the keeper element to hold the top closure in closed position, the upper ends of the two resilient legs of the V-shaped element being movable towards one another to permit the element to enter the keeper element after which the legs spring apart to retain the V-shaped element in the keeper element.

13. A carrying case as defined in claim 12 wherein the upper ends of the legs of the V-shaped element are formed with cam surfaces that upon engagement with keeper element operate to move the legs towards one another.

14. A carrying case as defined in claim 12 wherein each of said bottom closures contains a plurality of holes therein for permitting moisture and other foreign matter to be removed from its associated pocket.

* * * * *